US005628366A

United States Patent [19]

Telfer

[11] Patent Number: 5,628,366

[45] Date of Patent: May 13, 1997

[54] PROTECTIVE ARRANGEMENTS FOR DOWNHOLE TOOLS

[75] Inventor: George Telfer, East Tullos, Great Britain

[73] Assignee: Nodeco Limited of International Base, East Tullos, United Kingdom

[21] Appl. No.: 387,796

[22] PCT Filed: Aug. 18, 1993

[86] PCT No.: PCT/GB93/01755

§ 371 Date: Feb. 17, 1995

§ 102(e) Date: Feb. 17, 1995

[87] PCT Pub. No.: WO94/04790

PCT Pub. Date: Mar. 3, 1994

[30] Foreign Application Priority Data

Aug. 18, 1992 [GB] United Kingdom ..... 9217537

[51] Int. Cl.[6] ..... E21B 19/16; E21B 31/08

[52] U.S. Cl. ..... 166/380; 166/99

[58] Field of Search ..... 166/99, 107, 380, 166/297

[56] References Cited

U.S. PATENT DOCUMENTS

| | | | |
|---|---|---|---|
| 2,710,741 | 6/1955 | Hall, Sr. | 166/99 |
| 2,890,756 | 6/1959 | Middleton | 166/99 |
| 3,227,216 | 1/1966 | Bumpers | 166/99 |
| 3,741,321 | 6/1973 | Slover, Jr. et al. . | |
| 4,059,155 | 11/1977 | Greer | 166/99 X |
| 4,111,262 | 9/1978 | Duncan | 166/99 |
| 4,616,721 | 10/1986 | Furse | 166/99 X |
| 4,721,156 | 1/1988 | Campbell | 166/99 |
| 5,402,850 | 4/1995 | Lalande et al. | 166/99 X |

FOREIGN PATENT DOCUMENTS

| | | |
|---|---|---|
| 1267359 | 4/1990 | Canada . |
| 0206917 | 12/1986 | European Pat. Off. . |

*Primary Examiner*—Frank Tsay
*Attorney, Agent, or Firm*—Ratner & Prestia

[57] ABSTRACT

A protective arrangement or "junk bonnet" (30) for preventing debris entering a downhole tool assembly (14) employed in the drilling of a well. The junk bonnet (30) is in the form of an annular seal which fits around a tube (18) and inside a sleeve (24) which are relatively movable to operate a downhole tool assembly (14) of which they form part. The junk bonnet (30) is provided with sliding fluid seals (42, 44, 48, 50) which seal against the external surface (19) of the tube (18), and against the bore (25) of the sleeve (24). A longitudinal fluid passage (52) links opposite ends (54, 56) of the junk bonnet (30). The passage (52) is sealed in use by a plug (60) or other suitable valve. An annular volume ("C") below the junk bonnet (30), between the tube (18) and the sleeve (24), and above a seal (26) forming part of the downhole tool assembly (14) is filled through the passage (52) with hydraulic oil during setting-up and prior to closure of the passage (52) by the plug (60). This hydraulically locks the junk bonnet (30) in place on the downhole tool assembly (14), without reliance on any mechanical fastening, and yet free of susceptibility to being dislodged by normal operational movements of the downhole tool assembly (14). The upper end (56) of the junk bonnet (30) can be formed as a back-reamer, and an emergency release (72) can be incorporated.

20 Claims, 1 Drawing Sheet

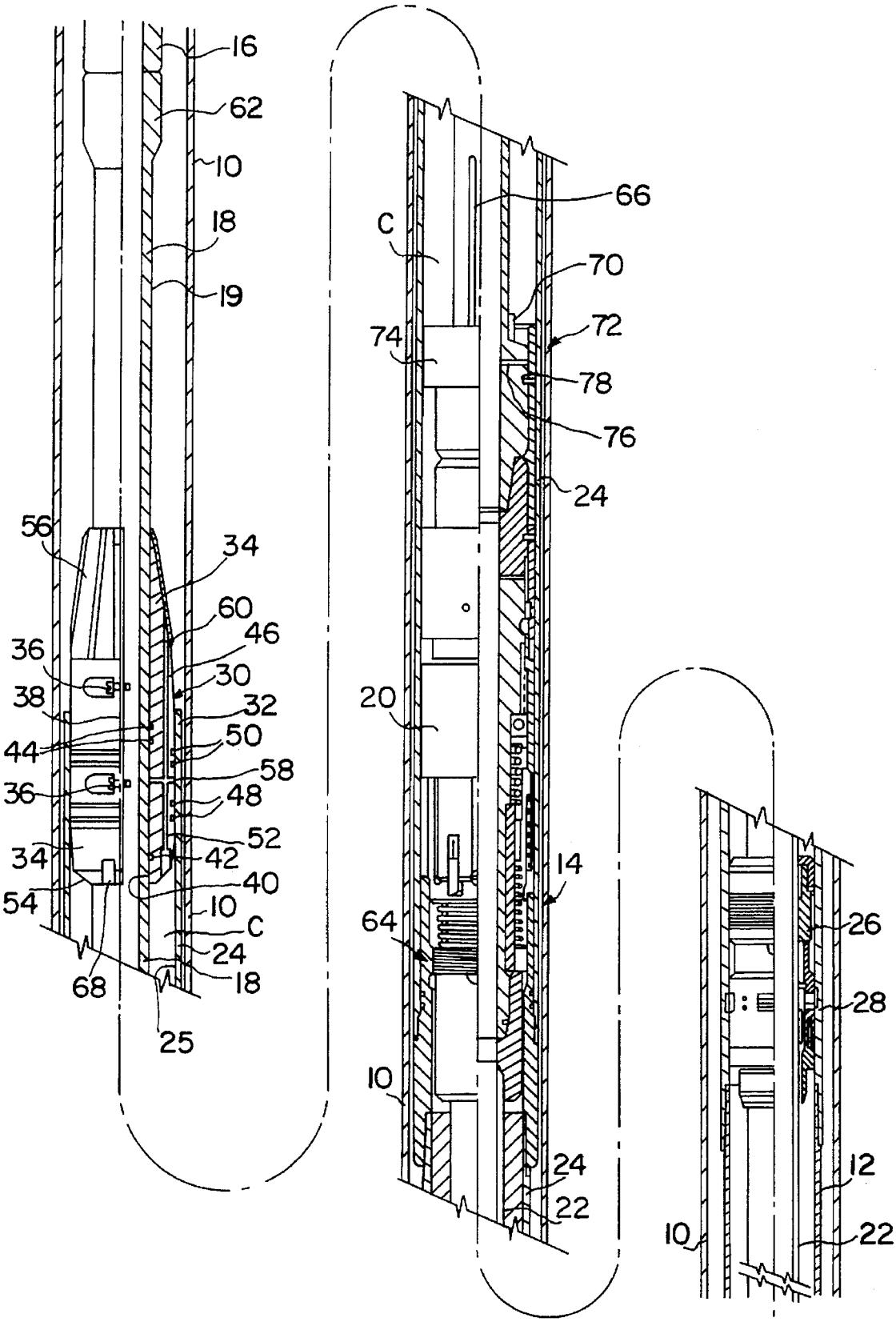
16
62
10
18
19
56
34
60
46
36
30
38
32
44
50
58
36
48
52
34
42
40
54
10
C
24
68
18
25
66
C
70
72
74
78
76
24
20
14
64
10
24
22
26
28
12
10
22

PROTECTIVE ARRANGEMENTS FOR DOWNHOLE TOOLS

FIELD OF THE INVENTION

This invention relates to protective arrangements, and relates more particularly but not exclusively to protective arrangements for downhole tool assemblies employed in the drilling of wells.

In the drilling of wells intended for exploration of subterranean formations and/or the eventual recovery of hydrocarbons or other minerals, much of the work involves drilling of the well. However, from time to time it is necessary to lower a tool assembly down the well for the accomplishment of related operations. For example, a liner running and cementing operation may be necessary in the course of drilling a well. Such tool assemblies have varying degrees of complexity, and frequently involve fluid flow passages and/or relatively movable components or sub-assemblies.

DESCRIPTION OF THE PRIOR ART

Proper functioning of such tool assemblies can be disrupted by the entry of drilling debris into the mechanism or fluid passages. A form of protective arrangement for obviating such debris-induced disruption is known as a "junk bonnet", and takes the form of a cap intended to shield the tool assembly from descending debris. However, known forms of junk bonnet do not provide a fluid seal, and are liable to be dislodged by movement of the drill pipe as part of operation of the tool assembly. These problems allow debris to enter the tool assembly, and result in failure of the protective arrangement. Further, the known forms of junk bonnet have a relatively large outside diameter which restricts fluid circulation in the annulus between the drill pipe and the casing, and which hinders easy removal of the tool assembly from the well when a large amount of cuttings and drilling debris has accumulated in the annulus.

It is therefore an object of the invention to provide a protective arrangement for a downhole tool assembly which obviates or mitigates these problems.

SUMMARY OF THE INVENTION

According to a first aspect of the present invention there is provided a downhole tool assembly comprising a sleeve member, a tube member axially movable with respect to and at least partially located within said sleeve member, a seal member mounted within a lower end of said sleeve member providing a sliding fluid seal to the exterior of said tube member or to the exterior of a tubular extension member thereof and having an external diameter substantially equal thereto, a downhole tool sub-assembly and a protective arrangement comprising an annular seal means characterised in that said annular seal means has an inner surface dimensioned to fit around said tube member and an outer surface dimensioned to fit within at least an upper end of said sleeve member, said inner surface being provided with an inner fluid seal means for forming a sliding fluid seal to the exterior of said tube member, said outer surface being provided with an outer fluid seal means for forming a sliding fluid seal to the interior of said sleeve member and the downhole tool sub-assembly being located within an annular Volume (C) between the seal member and said annular seal means, the Volume (C) being constant nothwithstanding movement of the tube member relative to the sleeve member.

The annular seal means preferably includes a fluid passage linking axially opposite ends of said annular seal means, and fluid flow control means selectively operable either to open said fluid passage to the flow of fluid therethrough between said axially opposite ends of said annular seal means or to close said fluid passage to the flow of fluid therethrough between said axially opposite ends of said annular seal means.

Said fluid flow control means may comprise a valve means fitted in said fluid passage or on one end thereof; said fluid flow control means more preferably comprises a plug insertable into said fluid passage for retention therein to block said fluid passage to fluid flow therethrough between said axially opposite ends of said annular seal means.

Said annular seal means preferably comprises a body which is axially divided into a plurality of mutually securable segments whereby said annular seal means may be assembled around a selected portion of said tube member of said tool assembly. Thereby said annular seal means need not be threaded onto a free end of said tube member during setting up of said protective arrangement as would be the case if the body of said annular seal means were in one piece. More preferably, said body is formed as a pair of hemi-annular segments which can be mutually secured by latches, clamps, bolts or any other suitable securing means. Gaskets may be incorporated between mating faces of said body segments to inhibit fluid leakage.

The axial end of said annular seal means which is uppermost and remote from said tool assembly in use of said protective arrangement is preferably formed as a reamer or debris cutter to facilitate withdrawal of said protective arrangement from a downhole location subsequent to use of said tool assembly.

The axial end of said annular seal means which is lowermost and adjacent said tool assembly in use of said protective arrangement is preferably formed with dog clutch means selectively engageable with matching dog clutch means on said tool assembly to enable said annular seal means to be selectively rotated by rotation of said tube member of said tool assembly during withdrawal of said protective arrangement from a downhole location subsequent to use of said tool assembly.

Said inner fluid seal means may comprise at least one elastomeric ring disposed in and standing proud of a circumferential slot or groove extending circumferentially around said inner surface, and more preferably comprises a plurality of elastomeric O-rings each disposed in and standing proud of a respective circumferential slot or groove each extending circumferentially around said inner surface.

Said outer fluid seal means may comprise at least one elastomeric ring disposed in and standing proud of a circumferential slot or groove extending circumferentially around said outer surface, and more preferably comprises a plurality of elastomeric O-rings each disposed in and standing proud of a respective circumferential slot or groove each extending circumferentially around said outer surface.

According to a second aspect of the present invention there is provided a method of assembling and setting up the protective arrangement according to the first aspect of the present invention in conjunction with a downhole tool assembly of the kind specified, said method comprising the steps of providing said annular seal means and said members of said tool assembly, threading said tube member or said tubular extension member thereof (if present) through said seal member mounted in said sleeve member, locating said annular seal means around said tube member and inserting said annular seal means into said upper end of said bore of said sleeve member while said fluid passage is initially open so as to form an annular volume bounded externally by said bore of said sleeve member, bounded internally by the exterior of said tube member and by the exterior of said tubular extension member thereof (if present), bounded at one end by said seal member, and bounded at the other end by said annular seal means, filling said annular volume with a hydraulic liquid such as to exclude substantially all gasses from said annular volume, and operating said fluid flow control means to close said fluid passage to the passage of fluid therethrough between said axially opposite ends of said annular seal means whereby said annular seal means is retained in said upper end of said sleeve member substantially only by hydraulic forces resulting from the substantial invariability of said annular volume upon relative axial movement of said tube member and of said tubular extension member thereof (if present) with respect to said sleeve member and said seal member mounted therein.

According to a third aspect of the present invention there is provided a combination of a protective arrangement according to the first aspect of the present invention and a downhole tool assembly of the kind specified, assembled and set up by the method according to the second aspect of the present invention.

Said downhole tool assembly preferably incorporates an emergency release assembly in said tube member or in said tubular extension member thereof (if present) or therebetween (for example, in a further component or sub-assembly of said tool assembly), said emergency release assembly preferably comprising a coupling means mechanically and hydraulically coupling parts of said tool assembly above and below said coupling means, said coupling means incorporating shear means rupturable to part said coupling means by an upward force applied through said tube member and in excess of a predetermined normal maximum upward force prevailing during non-emergency operation. Said coupling means preferably incorporates a vent opened by parting of said coupling means to vent said annular volume and so hydraulically release said annular seal means from its normal hydraulic retention in said upper end of said sleeve member.

Said tube member preferably incorporates a longitudinal seal bypass means at a location on the exterior surface thereof normally below said annular seal means but capable of being lifted, by upward movement of said tube member with respect to said annular seal means, to a higher location in which said longitudinal seal bypass means longitudinally bypasses said inner seal means of said annular seal means to vent said annular volume and so hydraulically release said annular seal means from its normal hydraulic retention in said upper end of said sleeve member.

BRIEF DESCRIPTION OF THE DRAWINGS

Embodiments of the present invention will now be described by way of example with reference to the accompanying drawing, the sole FIGURE of which is a longitudinal elevation of a length of casing and hanger/liner enclosing a downhole tool assembly incorporating a protective arrangement in accordance with the invention, the right half of the FIGURE being radially sectioned as far as the centre-line of the assembly, and the left half of the FIGURE being conventionally radially sectioned (is to show the radially external surface of the radially innermost entities of the assembly).

DESCRIPTION OF PREFERRED EMBODIMENTS

Referring to the FIGURE, there is shown a downhole section of previously drilled well lined with 9⅝ inch (244.5 millimeter) casing 10. A 7 inch (177.8 millimeter) liner 12 is shown run within the casing 10 on the lower end of a liner running/cementing downhole tool assembly 14 of known form. The tool assembly 14 is suspended within the casing 10 on the lower end of a drill pipe 16.

Those parts of the tool assembly 14 which are of significance to the present invention are a setting tool tube member 18 having an inside diameter of 71.4 inch millimeters and an external surface 19 with a diameter of 100 millimeters, a running tool sub-assembly 20 below the tube member 18, and a tubular stinger extension member 22 depending from the sub-assembly 20. The tubular extension member 22 of the tool assembly 14 has an external diameter of 100 millimeters, ie the same external diameter as the external diameter of the tube member 18. The tool assembly 14 further comprises a coaxial PBR (polished bore receptacle) sleeve member 24 to the lower end of which the liner 12 is attached, coaxially with the sleeve member bore 25. Mounted within the lower end of the sleeve member 24 is an annular seal 26 suspended on a 7 inch (177.8 millimeter) nipple 28 forming the lower end of the sleeve member 24. The annular seal 26 forms a sliding fluid seal on the tubular external surface of the tubular extension member 22 of the tool assembly 14.

To protect the tool assembly 14 from having its correct operation disrupted by cuttings and other drilling debris falling into it, the tool assembly 14 is provided with a protective arrangement in the form of a junk bonnet 30 which is an annular seal assembly fitted around the tubular external surface 19 of the tube member 18 and within the tubular bore 25 at the upper end 32 of the s! eeve member 24 to provide a sliding fluid seal to each of these surfaces.

The junk bonnet 30 comprises two axially elongate hemi-annular segments 34 mutually secured by bolts 36, with gaskets 38 clamped between mating faces of the segments 34 to inhibit end-to-end fluid leakage.

The inner surface 40 of the annular junk bonnet 30 is provided with a lower inner seal 42 in the form of an elastomeric O-ring mounted within a circumferential slot extending around the inner surface 40, and is further provided with a pair of upper inner seals 44 each in the form of an elastomeric O-ring mounted within a respective circumferential slot extending around the inner surface 40.

The outer surface 46 of the annular junk bonnet 30 is provided with a pair of lower outer seals 48 each in the form of an elastomeric O-ring mounted within a respective circumferential slot extending around the outer surface 46, and is further provided with a pair of upper outer seals 50 each also in the form of an elastomeric O-ring mounted within a respective further circumferential slot extending around the outer surface 46.

Each of the O-ring seals 42, 44, 48, and 50 stands slightly proud of its respective mounting slot to form a sliding seal with the external surface 19 of the tube member 18 and with the bore 25 of the sleeve member 24, respectively. A longitudinal fluid passage 52 extends between and hydraulically links the lower axial end 54 of the junk bonnet 30 with its upper axial end 56, for a purpose detailed subsequently. A transverse fluid passage 58 links the longitudinal fluid passage 52 with the inner surface 40 between the upper and lower inner seals 44, 42, and with the outer surface 46 between the upper and lower outer seals 50, 48, for a purpose also to be detailed subsequently. The longitudinal fluid passage 52 can be selectively blocked or opened for the passage of fluid through the junk bonnet 30 between its axially opposite ends 54 and 56, by the insertion or removal of a screw-threaded plug 60.

Setting up of the above arrangement will now be described.

At the well surface, components of the tool assembly 14 are put together in known manner, with the annular seal 26 mounted within the nipple 28 in the lower end of the sleeve member 24, and the tubular stinger extension member 22 threaded therethrough to form a sliding fluid seal therewith.

The pair of junk bonnet segments 34 are assembled around the tube member 18 of the tool assembly 14, thereby avoiding potential problems in having to thread the junk bonnet 30 over the pipe connector 62 by which the tube member 18 will be attached in use to the drill pipe 16. (The inner seal rings 42 and 44 can be fitted over the pipe connector 62, since these rings are elastic and circumferentially stretchable). The rings 42 and 44 are fitted into their slots on the inner surface 40, the gaskets 38 are placed between the mating faces of the segments 34 which are then mutually clamped by the bolts 36, the outer seal rings 48 and 50 are fitted into their slots on the outer surface 46, and the thus-assembled junk bonnet 30 is slid down the external surface 19 of the tube member 18 to be inserted into and rest partly within the bore 25 at the upper end 32 of the sleeve member 24.

This arrangement forms an annular volume, denoted "C" in the FIGURE, which is externally bounded by the bore 25 of the sleeve member 24, internally bounded by the exterior surface 19 of the tube member 18 in conjunction with the exterior of the tubular extension 22 and the tool sub-assembly 20 linking them, bounded at the lower end by the annular seal 26, and bounded at the upper end by the lower axial end 54 of the junk bonnet 30.

While the longitudinal fluid passage 52 through the junk bonnet is temporarily open by the absence of the plug 60, the annular volume "C" is filled with an appropriate oil or other suitable hydraulic fluid, such as to exclude all air from volume "C". (Total filling can be assisted by pushing the junk bonnet 30 down a short distance into the oil-filled sleeve member 24 such to force oil out of the passage 52). Volume "C" is then sealed by tight insertion of the plug 60.

Since the external diameters of the tube member 18 and of the tubular extension 22 are the same where they pass through the respective sliding fluid seals 44 and 26, longitudinal movement of the tube member 18 together with the tool sub-assembly 20 and the tubular extension member 22 with respect to the sleeve member 24 and the seal 26 mounted therein causes no change in the volume of the annular volume "C". Thus the junk bonnet 30 is hydraulically locked in its position plugging the upper end 32 of the sleeve member 24, without reliance on any mechanical fastening or the like, and yet free of susceptibility to being dislodged by normal operational lifting/lowering of the sub-assembly 20 within the downhole tool assembly 14.

When the combination of the tool assembly 14 and the junk bonnet 30 (set up as described above) is coupled to the drill pipe 16 and lowered downhole to an operational depth in the already-drilled well for the performance of a drilling associated operation therein (liner running and cementing in this example), the junk bonnet 30 prevents cuttings or other debris from dropping into the tool assembly 14, thus to serve as a protective arrangement therefor.

In the downhole tool operating configuration illustrated in the FIGURE, fluid can be circulated down the bore of the drill pipe 16 and the bore of the tube member 18, and through the bores of the tool sub-assembly 20 and of the tubular extension member 22, to discharge from the bottom (not shown) of the liner 12 and return uphole to the surface through the annulus between the tube member 18 and the casing 10. During such circulation, the volume "C" remains hydraulically sealed and protected from debris. The minimal outside diameter of the junk-bonnet 30 (less than the outside diameter of the sleeve member 24) obviates obstruction of circulation in the annulus between the tube member 18 and the casing 10.

Prior to cementing of the liner 12 in its intended place in the well, the liner running tool sub-assembly 20 is unscrewed from its initial (as set-up) screw attachment 64 to the sleeve member 24 of the downhole tool assembly 14 by anti-clockwise (as viewed from above) rotation of the drill pipe 16, and lifted by a meter or so to check for proper release of the screw attachment 64. Such operation of the downhole tool assembly 14 commonly causes entry of debris in prior art configurations of junk bonnet, but with the junk bonnet 30 of the present invention, such debris entry is entirely inhibited since the junk bonnet 30 fully seals the top of the sleeve member 24 and remains hydraulically locked in place.

At the end of the liner cementing operation, the drill pipe 16 and the running tool sub-assembly 20 are pulled from the well, leaving the sleeve member 24 and the liner 22 downhole. To achieve such withdrawal, it is necessary first to break the hydraulic locking of the junk bonnet 30 in the upper end 32 of the sleeve member 24. To this end, a longitudinal hydraulic bypass slot 66 is cut in the exterior surface of the tube member 18, at a location thereon sufficiently far down as to have no effect on setting-up, running, and cementing operations, but effective on sufficient lift being imparted to the drill pipe 16 as to run up the inner surface 40 of the junk bonnet 30 to an extent that the slot 66 bypasses the inner seals 44, thus breaking the hydraulic lock and freeing the junk bonnet 30.

There is a known problem in well drilling operations that the top of the cemented-in liner may accumulate such an excess of debris that the bypass slot 66 would become blocked before it as effective to break the aforementioned hydraulic locking of the junk bonnet 30. To obviate or mitigate this hazard, the upper axial end 56 of the junk bonnet 30 is optionally formed as a conical reamer, while the lower axial end 54 is formed with one or more notches 68 engageable by one or more matching axial lugs 70 on the upper end of the sub-assembly 20. The notches 68 and the lugs 70 function as a dog clutch to enable the junk bonnet 30 to be lifted and rotated to back-ream its way through the excess of debris.

To guard against continued jamming of the junk bonnet 30 despite such provision for back-reaming and/or failure of hydraulic lock breaking, the lower end of the tube member 18 is provided with an emergency release coupling 72 which connects the tube member 18 with the sub-assembly 20. The coupling 72 comprises an external sleeve 74 covering and hydraulically sealing the mutual junction of the tube member 18 with the sub-assembly 20, and a radial port 76 hydraulically linking the normally isolated bore through the tool assembly 14 with the annular volume "C". The sleeve 74 mutually secures the mating halves of the coupling 72 by means of an array of shear screws 78 selected to part upon application trough the drill pipe 16 and the tube member 18 of a predetermined lift force substantially in excess of lift forces applied in normal operation of the downhole tool assembly 14. Such overlift fractures the shear screws 78, parts the emergency release coupling 72, and vents volume "C" through the radial port 76. This breaks the hydraulic locking of the junk bonnet 30 and also provides additional circulation for debris clearance.

The transverse fluid passage 58 linking the fluid passage 52 and the inner and outer junk bonnet surfaces 40 and 46 allows testing of the junk bonnet seals 42, 44, 48 and 50 on a suitable test rig (not shown) prior to setting-up and use of the junk bonnet 30.

The above described exemplary embodiment of downhole tool assembly and of the protective arrangement therefor have been described in the context of a substantially vertically drilled well. However, such arrangements can also be employed in inclined and horizontal wells, and in analogous situations such as tunnelling and mining.

The present invention is not restricted to the exemplary embodiments described above, nor to the optional variations thereof also referred to, and other modifications and variations can be adopted without departing from the scope of the invention as defined in the appended claims.

I claim:

1. A downhole tool assembly comprising a sleeve member (24), a tube member (18) axially movable with respect to and at least partially located within said sleeve member (24), a seal member (26) mounted within a lower end of said sleeve member (24) providing a sliding fluid seal to the exterior of said tube member (18) or to the exterior of a tubular extension member (22) thereof and having an external diameter substantially equal thereto, a downhole tool sub-assembly (20) and a protective arrangement comprising an annular seal means (30) characterised in that said annular seal means (30) has an inner surface (40) dimensioned to fit around said tube member (18) and an outer surface (46) dimensioned to fit within at least art upper end of said sleeve member (24), said inner surface (40) being provided with an inner fluid seal means (42,44) for forming a sliding fluid seal to the exterior (19) of said tube member (18), said outer surface (46) being provided with an outer fluid seal means (48,50) for forming a sliding fluid seal to the interior of said sleeve member (24) and the downhole tool sub-assembly (20) being located within an annular Volume (C) between the seal member (26) and said annular seal means (30), the Volume (C) being constant nothwithstanding movement of the tube member (18) relative to the sleeve member (24).

2. A downhole tool assembly as claimed in claim 1 wherein said annular seal means includes a fluid passage linking axially opposite ends of said annular seal means, and fluid flow control means selectively operable either to open said fluid passage to the flow of fluid therethrough between said axially opposite ends of said annular seal means or to close said fluid passage to the flow of fluid therethrough between said axially opposite ends of said annular seal means.

3. A downhole tool assembly as claimed in claim 2, wherein said fluid flow control means comprises a valve means fitted in said fluid passage or on one end thereof.

4. A downhole tool assembly as claimed in claim 2, wherein said fluid flow control means comprises a plug insertable into said fluid passage for retention therein to block said fluid passage to fluid flow therethrough between said axially opposite ends of said annular seal means.

5. A downhole tool assembly as claimed in claim 1, wherein said annular seal means comprises a body which is axially divided into a plurality of mutually securable segments whereby said annular seal means is assembled around a selected portion of said tube member of said tool assembly.

6. A downhole tool assembly as claimed in claim 5, wherein said body is formed as a pair of hemi-annular segments mutually securable by latches or claims.

7. A downhole tool assembly as claimed in claim 5, wherein gaskets are incorporated between mating faces of said body segments to inhibit fluid leakage.

8. A downhole tool assembly as claimed in claim 1, wherein the axial end of said annular seal means which is uppermost and remote from said tool assembly in use of said protective arrangement is formed as a reamer or debris cutter to facilitate withdrawal of said protective arrangement from a downhole location subsequent to use of said tool assembly.

9. A downhole tool assembly as claimed in claim 1, wherein the axial end of said annular seal means which is lowermost and adjacent said tool assembly in use of said protective arrangement is formed with dog clutch means selectively engageable with matching dog clutch means on said tool assembly to enable said annular seal means to be selectively rotated by rotation of said tube member of said tool assembly during withdrawal of said protective arrangement from a downhole location subsequent to use of said tool assembly.

10. A downhole tool assembly as claimed in claim 1, wherein said inner fluid seal means comprises at least one elastomeric ring mounted in and protruding from a circumferential slot or groove extending circumferentially around said inner surface.

11. A downhole tool assembly as claimed in claim 10, wherein said inner fluid seal means comprises a plurality of elastomeric O-rings each mounted in and protruding from a respective circumferential slot or groove each extending circumferentially around said inner surface.

12. A downhole tool assembly as claimed in claim 1, wherein said outer fluid seal means comprises at least one elastomeric ring mounted in and protruding from a circumferential slot or groove extending circumferentially around said outer surface.

13. A downhole tool assembly as claimed in claim 12, wherein said outer fluid seal means comprises a plurality of elastomeric O-rings each disposed in and standing proud of a respective circumferential slot or groove each extending circumferentially around said outer surface.

14. A downhole tool assembly as claimed in claim 1, also comprising emergency release assembly in said tube member or in said tubular extension member thereof (if present) or therebetween (for example, in a further component or sub-assembly of said tool assembly).

15. A downhole tool assembly as claimed in claim 14, wherein said emergency release assembly comprises a coupling means mechanically and hydraulically coupling parts of said tool assembly above and below said coupling means, said coupling means incorporating shear means rupturable to part said coupling means by an upward force applied through said tube member and in excess of a predetermined normal maximum upward force prevailing during non-emergency operation.

16. A downhole tool assembly as claimed in claim 15, wherein said coupling means incorporates a vent opened by parting of said coupling means to vent said annular volume and so hydraulically release said annular seal means from its normal hydraulic retention in said upper end of said sleeve member.

17. A downhole tool assembly as claimed in claim 14, wherein said tube member incorporates a longitudinal seal bypass means at a location on the exterior surface thereof normally below said annular seal means but capable of being lifted, by upward movement of said tube member with respect to said annular seal means, to a higher location in which said longitudinal seal bypass means longitudinally bypasses said inner seal means of said annular seal means to vent said annular volume and so hydraulically release said annular seal means from its normal hydraulic retention in said upper end of said sleeve member.

18. A method of assembling and setting up the protective arrangement as claimed in claim 1, in conjunction with a downhole tool assembly of the kind specified, said method comprising the steps of providing said annular seal means and said members of said tool assembly, threading said tube member or said tubular extension member thereof (if present) through said seal member mounted in said sleeve member, locating said annular seal means around said tube member and inserting said annular seal means into said upper end of said bore of said sleeve member while said fluid passage is initially open so as to form an annular volume bounded externally by said bore of said sleeve member, bounded internally by the exterior of said tube member and by the exterior of said tubular extension member thereof (if present), bounded at one end by said seal member, and bounded at the other end by said annular seal means, filling said annular volume with a hydraulic liquid such as to exclude substantially all gasses from said annular volume, and operating said fluid flow control means to close said fluid passage to the passage of fluid therethrough between said axially opposite ends of said annular seal means whereby said annular seal means is retained in said upper end of said sleeve member substantially only by hydraulic forces resulting from the substantial lnvariability of said annular volume upon relative axial movement of said tube member and of said tubular extension member thereof (if present) with respect to said sleeve member and said seal member mounted therein.

19. A downhole tool assembly comprising a sleeve member (24), a tube member (18) partially located within said sleeve member (24), a running tool sub-assembly (20) below the tube member (18) and a tubular extension member (22) depending from the running tool sub-assembly (20), characterized in that the external diameter (19) of the tube member (18) is equal to the external diameter of the tubular extension member (22).

20. A downhole tool assembly comprising a sub-assembly (20) being located within an annular volume (C) externally bounded by a bore (25) of a sleeve member and internally bounded by an exterior surface (19) of a tube member (18) in conjunction with an exterior surface of a tubular extension (22) and the sub-assembly (20) linking them, and further bounded at a lower end by an annular seal (26) and at an upper end by a junk bonnet (30), characterized in that longitudinal movement of the tube member (18) together with the tool sub-assembly (20) and the tubular extension member (22) with respect to the sleeve member (24) and the seal (26) causes no change in the volume (C).

* * * * *